US006255260B1

(12) United States Patent
Stork

(10) Patent No.: US 6,255,260 B1
(45) Date of Patent: Jul. 3, 2001

(54) METAL FORMING LUBRICANT WITH DIFFERENTIAL SOLID LUBRICANTS

(76) Inventor: David J. Stork, P.O. Box 90298, Burton, MI (US) 48509-0298

( * ) Notice: Subject to any disclaimer, the term of this patent is extended or adjusted under 35 U.S.C. 154(b) by 0 days.

(21) Appl. No.: 09/381,012

(22) PCT Filed: Mar. 26, 1998

(86) PCT No.: PCT/US98/05882

§ 371 Date: Sep. 13, 1999

§ 102(e) Date: Sep. 13, 1999

(87) PCT Pub. No.: WO98/42809

PCT Pub. Date: Oct. 1, 1998

(51) Int. Cl.[7] ..... C10M 137/00
(52) U.S. Cl. ..... 508/421; 508/128; 72/42
(58) Field of Search ..... 508/421, 128; 72/42

(56) References Cited

U.S. PATENT DOCUMENTS

| | | |
|---|---|---|
| 3,250,103 | 5/1966 | Beaubien et al. . |
| 3,407,143 | 10/1968 | Pitchford . |
| 3,725,274 | 4/1973 | Orozco . |
| 3,925,214 | 12/1975 | Livingston et al. . |
| 3,953,344 | 4/1976 | Narushima . |
| 4,016,087 | 4/1977 | Narushima et al. . |
| 4,140,834 | 2/1979 | Marcantonio et al. . |
| 4,354,956 | 10/1982 | Camp . |
| 4,390,439 | 6/1983 | Schwartz et al. . |
| 4,474,669 | 10/1984 | Lewis et al. . |
| 4,493,780 | 1/1985 | Schwartz et al. . |
| 4,626,366 | 12/1986 | Frentrup et al. . |
| 4,649,224 | 3/1987 | Panek et al. . |
| 4,654,155 | 3/1987 | Kipp et al. . |
| 4,665,239 | 5/1987 | Panek et al. . |
| 4,673,518 | 6/1987 | Owens et al. . |
| 4,688,411 | 8/1987 | Hagita et al. . |
| 4,709,099 | 11/1987 | Panek et al. . |
| 4,752,405 | 6/1988 | Kyle et al. . |
| 5,141,659 | 8/1992 | Kashiwaya et al. . |
| 5,340,486 | 8/1994 | Willoughby . |
| 5,468,401 | 11/1995 | Lum et al. . |
| 5,837,658 | 11/1998 | Stork . |

OTHER PUBLICATIONS

Aldrich Catalog Hanbook of Fine Chemicals, 1996–1997, p. 1196.

*Primary Examiner*—Margaret Medley
*Assistant Examiner*—Cephia D. Toomer
(74) *Attorney, Agent, or Firm*—Brooks & Kushman P.C.

(57) ABSTRACT

A metal forming lubricant suitable for extreme condition use is formulated to contain one or more differential solid lubricants composed of a high melt temperature, substantially halogen-free thermoplastic in addition to conventional lubricants such as organic phosphate esters and natural and synthetic polymer waxes. The lubricants offer superior performance while resisting the tendency to foul metal working dies with gummy deposits.

20 Claims, No Drawings

METAL FORMING LUBRICANT WITH DIFFERENTIAL SOLID LUBRICANTS

This application is a 371 of PCT/US98/05882, field Mar. 26, 1998.

TECHNICAL FIELD

The present invention pertains to metal working lubricants. More particularly, the present invention pertains to film-forming aqueous lubricant compositions containing a lubricious organic phosphate ester, preferably a lubricious low melting polymer, and at least one non-fluorinated high melting polymer as dispersed phases. The lubricant compositions are especially useful in metal forging and similar operations, particularly cold forming and cold heading.

BACKGROUND ART

In metal forming operations, the presence of a metal working lubricant is a necessity. Without a suitable lubricant, the friction between the die and the workpiece is so great as to cause galling, scoring, and even tearing of metal. These problems are exacerbated in operations involving the formation of deep sections, for example two-piece metal beverage cans, vehicle oil pans, and particularly products of thick sections such as spark plug bases.

In the past, articles of relatively shallow section could be coated with a film of lubricating oil or a coating of a metallic soap. However, as the use of fewer drawing stages and stronger workpiece alloys pushed the processing envelope, such crude lubricants rapidly became obsolete. Further, the use of lubricating liquids and soft soap films is not conducive to the manufacturing environment, the former because of their inherent messiness, and the latter due to the softness and hygroscopicity of the films produced. Stearate and other fatty acid salts have been found to be problematic with respect to washing operations, causing plugging of drains.

Such lubricants are also incapable of being used in many modem metal forming operations where surface temperatures of the dies and metal workpieces may often exceed 500° C. and may occasionally rise to temperatures of c.a. 1000° C. or higher due both to friction generated between the die and workpiece as well as the heat generated internally in the workpiece due to plastic flow of metal. At these temperatures and at the high pressures associated with metal forming, even common "high pressure lubricants" are completely ineffective.

In addition to being lubricious under extreme operating conditions, a suitable metal forming lubricant must also possess other characteristics in order that it may be successfully used in a commercial setting. For example, the lubricant must not build up on the die, otherwise "break through" or striations may be formed. In some cases, the lubricant may form a residue of sufficient size such that the fully formed workpiece contains hollows corresponding to the built up residue, and thus produces a part which is not the mirror image of the die. This is particularly true with respect to solid inorganic lubricants such as graphite, vermiculite, molybdenum disulfide, and the like.

Furthermore, in most cases, it is desirable to coat the workpiece with lubricant remote from the metal forming operation. For example, metal blanks may be coated, dried, and shipped to the metal forming plant by a supplier. It is thus necessary that the lubricant coating be solid, non-tacky, and non-dusting. It is further necessary that the lubricant coating be sufficiently hard to resist damage during handling and shipping. Particularly for ferrous metal parts, the coating should be relatively non-hydroscopic and should not contain salts which promote rusting or corrosion. Examples of the latter are borates and nitrites, particularly the former.

Preparing lubricants with these often conflicting goals has proven difficult.

In U.S. Pat. No. 4,752,405 is disclosed a lubricant containing a metal soap, in this case an alkali metal salt of a $C_{12-30}$ fatty acid; a polyoxyethylene glycol having a molecular weight in the range of 1500 Da to 8000 Da; an acrylic film forming polymer; and a variety of surface active agents to promote complete mixing of the ingredients. However, while dried films of the lubricant composition exhibited improved hardness, the films were still relatively hygroscopic, absorbing only slightly less water than films containing metal soaps and metal borates, such as the films exemplified by U.S. Pat. No. 3,725,274. The water absorption is believed due to the use of polyoxyethylene glycols which themselves are considerably hydrophilic. The metal soaps and polyoxyethylene glycols, while being excellent low temperature, low pressure lubricants, lose their lubricity at higher temperatures and pressures, and are thus not suited for many modern deep drawing operations.

In U.S. Pat. No. 4,654,155 is disclosed a water-emulsifiable metal rolling lubricant containing a complex organic phosphate ester, an amine, a polyoxyalkylated oil, one or more polyoxyalkylene glycol or polyol esters, and a non-esterified polyoxyalkylene glycol. The composition was found to be highly lubricious by the three ball test. However, the composition is only suitable for operations where liquid coatings may be tolerated, such as metal rolling operations. Moreover, none of the ingredients is a high temperature, high pressure lubricant.

In U.S. Pat. No. 4,474,669 is disclosed a lubricant composition containing molybdenum disulfide, an acrylic ester, acrylic acid polymer, and a polyethylene wax in aqueous dispersion. The coating may be applied to a metal surface such as a beverage can blank and dried. Cans formed by deep drawing lubricant-coated steel compared favorably to cans formed from tin-plated steel in which the tin plating is naturally lubricious. However, the composition of U.S. Pat. No. 4,474,669 contains molybdenum disulfide (moly). Moly is widely known as a high pressure metal lubricant. However, it is very expensive and today is environmentally suspect. Thus, it must be recovered and disposed of properly or recycled, adding further to manufacturing cost. Moly also tends to leave deposits on the die.

A variety of compositions have been marketed which employ combinations of polyethylene wax with acrylic film forming polymers with and without other ingredients such as organic phosphate esters. Similar compositions containing polyvinylchloride polymers instead of polyethylene are also known, such as those disclosed in U.S. Pat. No. 3,725,274. Such compositions have been found suitable for modest drawing operations not involving either high temperature or exceptionally high pressure. Under the latter conditions, the films lose their lubricity, and galling, tearing, and other effects occur with regularity. Attempts to extend the range of such compositions by adding high temperature resistant lubricious polymers such as polytetrafluoroethylene (PTFE, Teflon®), polyvinylidene fluoride, and the like have not been successful. While lubricity is in some cases satisfactory, the fluorinated polymers have been found to leave a residue which requires frequent cleaning and reconditioning of the die.

It would be desirable to provide to the metal forming industry a metal lubricant which may be used as a dry, durable coating; which is useful even at exceptionally high pressures and temperatures; which is environmentally friendly; which is substantially free of hygroscopic borates or metal soaps; and which leaves very little residue on metal dies. It would be further desirable to provide such a lubricant in liquid form for those applications not requiring a previously applied coating. It would yet be further desirable to provide metal lubricants which leave a conductive residue on the formed parts.

SUMMARY OF THE INVENTION

It has now been surprisingly discovered that excellent film forming lubricant compositions may be prepared which offer extended processing windows in the areas of high pressure and high temperature lubricity, by combining organophosphate esters with conventional lubricant additives and at least one non-halogenated thermoplastic of high melting point such that high temperature processing is possible. The subject compositions unexpectedly leave little residue on dies and other metal forming fixtures, unlike highly halogenated thermoplastics such as PTFE. Preferably, at least two thermoplastics having differing operational ranges (differential solid lubricants) are used. Addition of minor amounts of conductive carbon black allow for conductive coatings which still fall within acceptable processing windows.

DESCRIPTION OF THE PREFERRED EMBODIMENTS

The subject invention lubricant compositions comprise a series of lubricant additives, each having its own range of effectiveness. In prior art lubricating compositions, the selection of lubricating components has been made only with the ultimate use in mind. For example, organic phosphate esters and polyolefin waxes, both known lubricants, have been combined and tested at proposed operating conditions without regard to their action under any other conditions. While not wishing to be bound to any particular theory, Applicant believes that a suitable metal working lubricant must provide lubricating ability over a wide range of temperature and pressure, in addition to merely being lubricious under extreme conditions, to be a successful extreme operating condition metal forming lubricant. While theoretically one component could demonstrate lubricity under both low temperature, low pressure condition and extreme conditions, in practice, no such lubricant has been identified. Thus, it is necessary to employ a plurality of lubricants, each of which is able to lubricate over a given range of conditions while not interfering with the lubricity of other components of the composition.

Further, and again without wishing to be bound to any particular theory, Applicant believes that the lubricity of a given compound above its melting point is related to the film forming capability and/or viscosity under a given set of operating conditions. Thus, polyethylene wax, which is quite lubricious as a solid, remains lubricious at its melting point and at higher temperatures up to a point where it no longer effectively produces a coherent film. This point may be related to viscosity, with the decreasing viscosity at higher temperatures preventing efficient film formation. It is believed that this is the reason why polyethylene waxes and similar polymers are not lubricious under extreme conditions. Of course, the chemical structure of the additive and the adhesion between the additive and the metal surface which the structure causes is also a factor in lubricity. Organic phosphate esters and sulfurized oils, for example, exhibit lubricity over a wider range than similar compounds, for example the non-sulfurized oils, despite having similar melting points and viscosities. This is believed due to the greater attraction the functionalized oils have with the metal surfaces.

Natural waxes such as montan, carnauba, etc., and polyalkylene waxes such as polyethylene, low molecular weight polypropylene, copolymers of ethylene and vinylacetate, and the like, are natural candidates for lubricating films. Such waxes can be supplied in solvent form or as microemulsions and dried to form slippery coatings. Addition of additives such as phosphate esters and their amine and ammonium salts increases the useful range in terms of pressure. However, such lubricants provide soft films unless combined with film formers, and lose their lubricity rapidly at elevated temperatures.

Applicants have surprisingly found that metal working lubricants having a wide operating range and suitable for extreme condition operation may be prepared by employing low to moderate condition lubricants in conjunction with one or more extreme condition lubricants which comprise finely dispersed high temperature non-halogenated thermoplastics. The use of low to moderate condition lubricants such as polyoxyethylene glycols and similar polyoxyalkylene polyols and polyol esters; organic sulfates and phosphates such as polyoxyalkylene phosphates, triaryl- and tri(higher alkylene) phosphates; and natural and polymer waxes such as polyethylene and poly(ethylene/vinyl acetate) copolymer waxes enable the subject compositions to be lubricious at low temperatures, while the high temperature thermoplastics extend the lubricity to extreme conditions. The lubricity afforded by the high temperature thermoplastics is particularly surprising in view of the fact that unlike polyethylene, which has a natural slippery feel; and unlike the halogenated thermoplastics such as PTFE, the high temperature non-halogenated thermoplastics are not considered lubricious at ordinary temperatures.

In certain applications, it is desirable that any coating remaining on the workpiece after forming be electrically conductive. As the preferred compositions of the present invention are not hydrophilic and contain substantially no salts, they would not be conductive after drying and after subsequent metal forming operations unless a conductive constituent is added. The applicant has found that adding conductive carbon black in minor amounts, i.e. amounts of from 0.001 parts to 0.25 parts per 10 parts of aqueous concentrate, and preferably from 0.005 to about 0.1 parts per 10 parts aqueous concentrate, allows for conductive coatings to be prepared, while still maintaining lubricity necessary for extreme metal forming operations. Surprisingly, the compositions containing conductive carbon show slightly higher effectiveness in high temperature forming operations, despite the fact that carbon black, unlike graphite, is not considered to be lubricious. Suitable conductive carbon blacks are generally those with a pH higher than 6.0 and preferably in the range of 7.0 to 10.0, a dibutylphthalate absorption of greater than 100 ml/100 g, and a percent volatiles of less than 3% by weight. Suitable conductive carbon blacks are available from numerous sources. A preferred carbon black is PRINTEX XE 2 available from Degussa AG.

The compositions of the subject invention thus comprise one or more low to moderate condition lubricants and one or more high temperature, non-halogenated polymers as a dispersed phase. The subject coating compositions, when desired for coating as a dry film, also contain minimally one film-forming polymer, and sufficient additives to stably disperse the polymer particles. The composition may further contain conventional additives such as anti-foamers, coalescing agents, anti-corrosion additives, etc. The compositions preferably contain no hygroscopic salts such as nitrites or borates, i.e. are borate-free. In the liquid, non-coating formulations of the subject invention, the film forming polymer may be dispensed with. In conductive formulations, the formulations contain conductive carbon black.

The compositions of the subject invention, as previously stated, are preferably borate-free, and as well are generally free of hygroscopic salts which have a tendency to cause corrosion, including, in a non-limiting sense, the borates, nitrates, nitrites, sulfates, chlorides, alkali metal hydroxides, carbonates, bicarbonates, etc. By "substantially free of" with reference to such salts is meant that the composition contains none of such salts or amounts present as unavoidable impurities in system components. In general, less than 2% of such salts by weight may be tolerable, as such amounts do not materially change the nature of the composition. They do not measurably increase lubricity over similar compositions not containing these salts, for example.

The subject lubricants are also preferably free of metal soaps, i.e. metal salts of saturated and unsaturated fatty acids, examples of which include the alkali metal, alkaline earth metal, zinc, etc., salts of stearic and palmitic acids. It would not depart from the spirit of the invention, as in the case of metal salts, to add most minor amounts of metal soaps which do not materially affect the basic nature of the lubricant, i.e. less than 2% by weight based on the weight of the concentrate. Thus, the compositions should be substantially free of metal soaps, and preferably totally free of such soaps.

The lubricant compositions are, by the same token, preferably free of inorganic solid lubricants. By "inorganic solid lubricants" is meant lubricants which are inorganic and which are insoluble in water or in the prepared lubricant composition. Examples of such inorganic solid lubricants are vermiculite and mica, whether or not exfoliated; graphite; molybdenum disulfide, and other common inorganic solid lubricants. Again, it would not depart from the spirit of the invention to include a most minor amount of these such that the material characteristics of the aqueous lubricant composition are not altered. Amounts of less than about 2 weight percent, for example, meet this requirement. However, it is preferred that these ingredients be totally absent. It should be noted that the term "inorganic solid lubricant" does not include conductive carbon black.

The subject compositions in like manner are also preferably free of hydrophillic colloids, carbohydrates, i.e. starch, and other similar ingredients, which may increase water absorption, which may render dried films tacky, or which may be subject to biological microorganism growth.

By the term "low to moderate condition lubricants" is meant lubricants which are of low melting point or are liquids, and are suitable for use at temperatures and pressures up to and including the temperatures and pressures at which polyethylene wax is suitable. One skilled in the art has no difficulty selecting such lubricants, and may be further guided by the following listing of low to moderate condition lubricants which is exemplary and not limiting. Examples of suitable low to moderate pressure lubricants include mineral oil; lubricating oil; natural vegetable oil (triglycerides); sulfurized and phosphatized oils; organic esters such as the α-alkylglucosides, polyoxyalkylated a-alkylglucosides; sorbitan oxyalkylates and sorbitan esters; fatty acid esters; fatty acid amides; long chain alkyl- and aralkylamines and polyamines; alkanolamines, particularly dialkanolamines and trialkanolamines; natural waxes such as montan wax, carnauba wax, mineral wax (paraffin); polyoxyalkylene sulfate and phosphate esters and other complex organic sulfates and phosphates; polyoxyethylene glycols, polyoxypropylene glycols, tri- and higher functional polyoxyalkylene polyols, and their amino group terminated and mono- and polyester derivatives; and polyalkylene waxes such as polyethylene homopolymer waxes and copolymer waxes prepared by block and/or random polymerization of ethylene and other unsaturated monomers such as vinylacetate, vinylchloride, acrylic acid, methacrylic acid, methylacrylate, methylmethacrylate, butylacrylate, maleic anhydride, styrene, α-methylstyrene, cyclopentene, norbornene, and the like. The polyethylene waxes have melting points in the range of 70° C. to 125° C. Examples of organic phosphates may be found in U.S. Pat. No. 4,654,135, which is herein incorporated by reference. The organophosphate esters and some of the other cited low to moderate temperature lubricants, particularly those which have been functionalized with metallophilic functional groups may exceed the lubricity of the polyethylene waxes and like compounds at elevated temperatures.

Especially useful are combinations of low condition lubricants and moderate condition lubricants. Quite often, the effectiveness of the low condition lubricants overlaps or extends to the limits of the effectiveness of the moderate condition lubricants. For example, complex organic phosphates such as MASLIP® 504 are effective under low pressures and at low temperatures where polyethylene waxes are not particularly effective, yet these phosphates maintain some, although limited, effectiveness throughout most of the range at which polyethylene waxes are efficient. However, triisopropanolamine, an effective lubricant under low conditions, loses its effectiveness rapidly as the temperatures and pressures increase. Even so, lubricants such as triisopropanolamine are still useful for their low pressure, low temperature contribution as well as performing the function of solubilizing and aiding in the dispersing of other ingredients.

The critical component of the subject invention lubricants is the high temperature, non-halogenated thermoplastic polymer. By the term "non-halogenated" is meant that less than 10 mol percent of the monomers used to prepare the polymer are halogenated monomers which retain or substantially retain the halogen moiety after polymerization. Examples of halogenated monomers are vinyl chloride, vinylidene chloride, vinylidene fluoride, tetrafluoroethylene, and the like. Halogen-containing monomers such as 4,4'-dichlorodiphenylsulfone, wherein the halogen is lost during the polymerization process, is not a halogenated monomer. The term "non-halogenated" further includes halogen-free or substantially halogen-free polymers which are later halogenated, so long as not more than about 10%, preferably less than 5% by weight of the polymer consists of halogen. It is preferred that the polymers be halogen-free, i.e. contain no intentionally introduced halogen atoms.

By the term "high temperature" is meant a polymer whose melting point is considerably above that of polyethylene wax and polyethylene oligomeric polymers, i.e. significantly above 200° C., preferably above 250° C., more preferably above 350° C., and most preferably of higher melting point. The polymer must, however, be thermoplastic, and must have a melting point, i.e. it must melt before any substantial decomposition takes place. Polymers whose decomposition temperatures are lower than their melting temperatures are not useful unless such polymers comprise block polymers of thermally stable blocks bonded together with one or more thermally decomposable linkages. Such polymers will have a melting point of the block polymer segments which can be identified by Differential Scanning Calorimetry (DSC) preceded by a lower decomposition temperature. However, the modulus will remain at a value far above that associated with a liquid even at the decomposition temperature, until a substantial number of linkages are broken, essentially liberating a polymer of lower melting point.

The polymers will be essentially thermoplastic, i.e. essentially linear molecules having minimal crosslinking. However, a limited amount of purposeful or unintentional crosslinking may be present so long as the polymers are still able to melt and flow at the temperatures and pressures utilized.

Non-limiting examples of suitable high temperature thermo-plastic polymers include polyamides, high molecular weight polyolefins, polyarylenesulfones, polyarylene oxides, polyarylene sulfides, polyethersulfones, polyetherketones, polyimides, polyetherimides, polycarbonates, polyoxymethylenes, polyesters, and the like.

The polyamides are particularly useful, particularly the liquid crystalline polyamides and aramids. Polyamides with melting points in the range of 200 to 300° C., i.e. polyamide 66, may be useful at the lower end of the extreme lubricant range, and under far more strenuous conditions than polyethylene waxes and the like. However, extension of the processing parameters of the subject lubricants to extreme conditions requires use of liquid crystalline polyamids, aramids, or other high melting polyamides. Preferably, the polyamides have a melt temperature of 300° C. or greater, preferably 350° C. or greater. Aramides such as Nomex® and Kevlar® have high melt temperatures ($T_m$) for example in the range of 365° C. to 500° C. Such polyamides are commercially available.

High temperature polyolefins are also useful. Unlike polyethylene waxes which are oligomeric and often contain additional comonomers to further lower melting points, high temperature polyolefins are prepared using catalyst systems which encourage high molecular weight and structural uniformity which causes these polymers to have high melting points. Ultra high molecular weight polyethylene and polypropylene, particularly polypropylene having a high degree of isotacticity may be suitable. However, in particular, polymers of cyclohexene, of cyclopentene, of norbornene, and the like, optionally substituted with alkyl groups are suitable, as well as their copolymers. Such polymers are commercially available. For example, isotactic poly(3methyl-1-butane) and isotactic poly(4methyl-1-pentene) have melting points ($T_m$) of 310° C. and 240° C., respectively. A dispersion containing high melt temperature polyethylene is available as SLIP-AYD 630 from Daniel Products.

Polyarylenesulfones, polyether ketones, and polycarbonates are characterized by the repeating structure:

$$-[\phi-X-\phi-Y]_n-$$

where each $\phi$ represents the same or a different aryl moiety such as, but not limited to, substituted and unsubstituted phenyl, biphenyl, naphthyl, diphenylether, diphenylmethane, and diphenylisopropylidene, wherein the preferred substituents are $C_{1-4}$ alkyl groups, and wherein X and Y are the same or different, and represent —O—, —S—, —SO—, —$SO_2$—, —CO—, O—CO—O, and the like. Such thermoplastics are readily available commercially.

Also useful are polyesters. Polyesters are derived from the condensation esterification of a diacid and a glycol. Both conventional and liquid crystalline polyesters are useful. Examples of polyesters are high molecular weight polyethyleneadipates, polybuthyleneadipates, polyethyleneterephthalates ($T_m$=245° C.), polybutyleneterephthalates, polycyclohexanedimethyleneterephthalates, etc. Once again, such polyesters are commercially available.

Polyimides and polyetherimides are further useful. Examples of polyimides are Kaptor® and Lenzing 2080. An example of a suitable polyetherimide is Ultem®, a product of General Electric.

The high temperature thermoplastic must be utilized in finely divided form such that a stable dispersion results. Such dispersions are preferably resistant to sedimentation of solid components for at least several days without agitation. The polymers may be supplied in the form of fibers or yarns which are chopped into relatively low aspect fibers, i.e. fibers having an aspect ratio (length:diameter) of from about 10:1 to about 1:10. The finer the diameter of the fiber, the higher the aspect ratio which can be tolerated.

For example, with micron or submicron sized fibers, aspect ratios as high or higher than 20–100:1 may be tolerated. Recently, a special form of fibrous Kevlar® polyaramid fiber has been developed which is highly suitable. These fibers, known as Kevlar® 1F543, have been touted for use as thickeners and thixotrophy agents, and have numerous microfiber tendrils off the principle fibers which gives them a particularly high surface ratio.

The high temperature thermoplastic polymers may also be used in finely divided form produced by such techniques as gas jet milling, sand milling, cryogenic grinding, spray drying, solution precipitation, and the like. For example, a particular polymer may be dissolved in a strong, aprotic, water miscible solvent such as N-methylpyrollidone, dimethylsulfoxide, dimethylacetamide, or dimethylformamide, and poured into water, or another non-solvent with which the aprotic solvent is miscible, under high sheer agitation to produce generally spherical or elongate microparticles of polymer. Particle sizes of 0.05 $\mu$m to 50 $\mu$m, preferably 0.1 $\mu$m to 10 $\mu$m are preferred.

The high temperature thermoplastic may be present in amounts ranging from about 0.1 weight percent to about 20 weight percent based on the weight of non-volatile ingredients, preferably from about 1 weight percent to about 10 weight percent. Higher percentages may be useful when two or more high temperature thermoplastic polymers spanning two temperature ranges are used. For example, an extended range lubricant composition may have low temperature/pressure lubricants such as triisopropylamine and MASLIP® 504 phosphate ester; a lubricant such as SLIP-AYD® 630, a polyethylene wax and high melt temperature polyethylene dispersion available from Daniel Products; an extreme condition, high temperature/pressure lubricant of nylon 44 or nylon 46 particles or fibers, and an extreme condition very high temperature/pressure lubricant of Kevlar® fibrils.

In the film forming compositions of the subject invention, the ingredients contain a film forming polymer. The film forming polymer is one which is soluble or dispersible in the remaining ingredients, which preferably forms a substantially non-tacky film when dry, the film being relatively hard. Suitable film forming polymers are well known and include various polyacrylates, polyvinylacrylates, styrene-acrylic copolymers, polyurethanes, and the like. An example of a suitable film forming polymer is JONCRYL® 678 acrylic resin, a product of S.C. Johnson & Son, believed to contain 1–3 weight percent diethyiene glycol monoethyl ether and a styrene-acrylic copolymer. JONCRYL® 678 is nominally a solid in the form of clear flakes, has an acid value of 200, a density of 1.25 g/$cm^3$, and a number average molecular weight of c.a. 8000. However, the particular film forming polymer is not overly critical. "Film forming polymers" are those capable of being cast as a film from aqueous solution, emulsion, or dispersion, and do not include polymers which can only be extruded or organic solvent cast, e.g. PTFE.

The film, as indicated, is preferably non-tacky or substantially non-tacky. By "substantially non-tacky" means that the degree of tackiness or adhesiveness felt by a touch is at most small. However, some tackiness can be tolerated, particularly if the lubricant is to be applied to the workpiece in the same building and can be shielded from dust or dirt pickup. Under these conditions, even relatively tacky, or "sticky" films, may be used. However, in many cases, workpieces are coated at a distant location and shipped. Under these conditions, a low degree of tack is desired. The film should also be relatively hard so that it is not easily scratched, abraded, or removed during routine handling. Those skilled in the art readily understand the meanings of the terms "tack," "substantially tack free," "hard" in relation to the film hardness, and the like.

If use of the lubricant of the subject invention in a liquid state can be tolerated, then the film forming polymer or a portion of it may be eliminated from the formulation. However, in such cases, it may be advisable to introduce a soluble polymeric thickener, for example a standard poly-acrylic acid thickener or an associative thickener such as those disclosed in U.S. Pat. Nos. 4,709,099; 4,673,518; 4,665,239; 4,649,224; and 4,354,956 in order to increase the viscosity to aid in applying and maintaining the coating. For example, it may be desirable to utilize a lubricant which has the composition of a cream or gel, or is thixotropic. Further, enough film forming polymer or an equivalent is necessary to act as a sticking agent to promote adhesive of the lubricant composition to the workpiece. Further ingredients including anti-corrosion agents, other pressure reducing additives, and lubricity aids such as those disclosed in U.S. Pat. Nos. 4,390,439; 4,493,780; 4,626,366; and 4,797,299, which are herein incorporated by reference.

Preferred compositions are concentrates containing, based on solids, from about 0.5 weight percent to about 20 weight percent, more preferably about 1 weight percent to about 10 weight percent of a film forming polymer; from 0.1 weight percent to about 20 weight percent, more preferably 1 weight percent to about 10 weight percent of an organic phosphate ester; from 0 weight percent to about 30 weight percent, more preferably 1 weight percent to about 20 weight percent of one or more polyethylene or similar low melting waxes; and from 0.1 weight percent to about 20 weight percent, more preferably 0.1 weight percent to about 10 weight percent of at least one high melt temperature thermoplastic. Conductive carbon black, when used, is preferably in the range of about 0.01 weight percent to about 2.5 weight percent, more preferably 0.01 weight percent to about 0.5 weight percent. The concentrations thus formed may be diluted at a ratio of 0.5 parts concentrate to 99.5 parts water, more preferably a concentrate to water ratio of 5:95, yet more preferably 10:90, and advantageously 30:70. Higher or lower dilution may be used as desired.

Having generally described this invention, a further understanding can be obtained by reference to certain specific examples which are provided herein for purposes of illustration only and are not intended to be limiting unless otherwise specified.

EXAMPLE 1

A film-forming metal working lubricant composition is prepared by thoroughly mixing the following ingredients until a uniform, stable dispersion results. Parts by weight are of the as-supplied components.

| | Ingredient | Parts by Weight |
|---|---|---|
| 1. | SLIP-AYD ® SL 630 | 62 |
| 2. | JONCRYL ® 537 | 24 |
| 3. | MASLIP ® 504 | 3.6 |
| 4. | AGROSOL OT 75 | 0.5 |
| 5. | Triisopropanolamine | 0.5 |
| 6. | BYK 032 | 0.24 |
| 7. | Water | 8.8 |
| 8. | High Temperature Polymer Lubricant (Kevlar ® and/or SPECTRA ® Fibers) | 0.1 to20 |

Ingredient 3 was sheared into ingredient 2 until a homogenous mixture resulted, Ingredients 4, 5, and 6 were blended together with mild agitation (hand mixing), following which ingredient 7 is added. The admixture of ingredients 4–7 is then sheared with the admixture of 2 and 3 until homogenous. Ingredient 8 is blended with ingredient 1, following which this blend is mixed with gentle agitation with the preceding ingredients.

The amount of high temperature polymer is dependent upon the end use, with higher amounts, i.e. 5% by weight to 10% by weight or more suitable for cold forging while lower amounts, i.e. 0.1 to 5%, are suitable for drawing and stamping operations.

A formulation as above, and containing 0.5–40% by weight Kevlar® 1F542 fibers is compared to a similar product not containing Kevlar. The Kevlar® formulation produced a superior product. The formulation compared to a teflon-containing lubricant is superior as the teflon-containing lubricant forms a gummy coating on the die after several uses.

EXAMPLE 2

In the same manner as Example 1, a concentrate was prepared from the following ingredients:

| | |
|---|---|
| 5.62 parts | SLIP-AYD 630 |
| 2.16 parts | JONCRYL 537 |
| .65 parts | MASLIP 504 Phosphate Ester |
| .08 parts | of CYTER OT75, or Disperse AYD W22 Dispersing Agent |
| .08 parts | Triisopropanolamine |
| .02 parts | BYK 032 Antifoam |
| .9 parts | Dapro W95HS Tension Modifier (Daniel Products) |
| .79 parts | Water |
| 10.3 parts | Total |

The concentrate showed excellent cold forming and cold heading lubrication at dilutions of 10:90 and 30:70.

EXAMPLE 3

To the concentrate of Example 2 is added 0.05 parts Degussa PRINTEX XE 2 carbon black. The lubricity is not as high as the Example 2 lubricant, but is comparable or superior to commercial lubricants not containing carbon black.

Having now fully described the invention, it will be apparent to one of ordinary skill in the art that many changes and modifications can be made thereto without departing from the spirit or scope of the invention as set forth herein.

What is claimed is:

1. An aqueous metal working lubricant suitable for extreme condition lubrication in metal forming operations, comprising:

water and an organic phosphate ester lubricant; and dispersed therein one or more finely divided, high melt temperature, substantially halogen-free thermoplastics having a $T_m$ of about 200° or greater, said aqueous metal lubricant substantially free of borates.

2. The metal working lubricant of claim 1 wherein said high melt temperature thermoplastic has a $T_m$ greater than about 300° C.

3. The metal working lubricant of claim 1 wherein said high melt temperature thermoplastic has a $T_m$ greater than about 400° C.

4. The metal working lubricant of claim 1 comprising at least two high melt temperature, substantially halogen-free thermoplastics differing in $T_m$ by at least 50° C.

5. The metal working lubricant of claim 1 comprising at least two high melt temperature, substantially halogen-free thermoplastics differing in $T_m$ by at least 100° C.

6. The composition of claim 1 which further comprises a film forming polymer which upon evaporation of water leaves a substantially to non-tacky and non-hygroscopic film.

7. The composition of claim 1 wherein at least one of said one or more high melt temperature, substantially halogen-free thermoplastics is selected from the group consisting of an aramid having a $T_m$ of greater than 350° C. and a polyolefin having a $T_m$ greater than 250° C.

8. The composition of claim 6, comprising:

a) from 2.5 to about 35 weight percent of said film forming polymer;

b) from about 0.5 weight percent to about 20 weight percent of a polyoxyalkylene phosphate ester as said organic phosphate ester lubricant;

c) from 0.1 to about 20 weight percent of one or more high $T_m$, substantially halogen-free thermoplastics having a melt temperature $T_m$ greater than about 200° C. as at least one of said one or more high melt temperature thermoplastics; and further comprising:

d) from 2.5 to about 35 weight percent of a natural or synthetic wax having a melting point of about 125° C. or below; and optionally, e) from 0 to about 20 weight percent of one or more dispersion-stabilizing and/or coalescence promoting surfactants.

9. The composition of claim 1 further comprising from about 0.01 weight percent to about 2.5 weight percent based on the total weight of said composition of conductive carbon black.

10. A diluted metal working lubricant comprising the lubricant of claim 1 diluted with from 1 part to about 99 parts water per part of said lubricant of claim 1.

11. An aqueous metal working lubricant suitable for extreme condition lubrication in metal forming operations, comprising:

water and an organic phosphate ester lubricant; and dispersed therein one or more finely divided, high melt temperature, substantially halogen-free thermoplastics having a $T_m$ of about 200° or greater, said aqueous metal lubricant substantially free of metal soaps.

12. The metal working lubricant of claim 11 comprising at least two high melt temperature, substantially halogen-free thermoplastics differing in $T_m$ by at least 50° C.

13. The metal working composition of claim 11 which further comprises a film forming polymer which upon evaporation of water leaves a substantially non-tacky and non-hygroscopic film.

14. The composition of claim 13, comprising:

a) from 2.5 to about 35 weight percent of said film forming polymer;

b) from about 0.5 weight percent to about 20 weight percent of a polyoxyalkylene phosphate ester as said organic phosphate ester lubricant;

c) from 0.1 to about 20 weight percent of one or more high $T_m$, substantially halogen-free thermoplastics having a melt temperature $T_m$ greater than about 200° C. as at least one of said one or more high melt temperature thermoplastics; and further comprising:

d) from 2.5 to about 35 weight percent of a natural or synthetic wax having a melting point of about 125° C. or below; and optionally, e) from 0 to about 20 weight percent of one or more dispersion-stabilizing and/or coalescence promoting surfactants.

15. The composition of claim 11 further comprising from about 0.01 weight percent to about 2.5 weight percent based on the total weight of said composition of conductive carbon black.

16. An aqueous metal working lubricant suitable for extreme condition lubrication in metal forming operations, comprising:

water and an organic phosphate ester lubricant; and dispersed therein one or more finely divided, high melt temperature, substantially halogen-free thermoplastics having a $T_m$ of about 200° or greater, said aqueous metal lubricant substantially free of inorganic solid lubricants.

17. The metal working lubricant of claim 16 comprising at least two high melt temperature, substantially halogen-free thermoplastics differing in $T_m$ by at least 50° C.

18. The composition of claim 16 which further comprises a film forming polymer which upon evaporation of water leaves a substantially non-tacky and non-hygroscopic film.

19. The composition of claim 18, comprising:

a) from 2.5 to about 35 weight percent of said film forming polymer;

b) from about 0.5 weight percent to about 20 weight percent of a polyoxyalkylene phosphate ester as said organic phosphate ester lubricant;

c) from 0. 1 to about 20 weight percent of one or more high $T_m$, substantially halogen-free thermoplastics having a melt temperature $T_m$ greater than about 200° C. as at least one of said one or more high melt temperature thermoplastics; and further comprising:

d) from 2.5 to about 35 weight percent of a natural or synthetic wax having a melting point of about 125° C. or below; and optionally, e) from 0 to about 20 weight percent of one or more dispersion-stabilizing and/or coalescence promoting surfactants.

20. The composition of claim 16 further comprising from about 0.01 weight percent to about 2.5 weight percent based on the total weight of said composition of conductive carbon black.

* * * * *

UNITED STATES PATENT AND TRADEMARK OFFICE

CERTIFICATE OF CORRECTION

PATENT NO. : 6,255,260 B1
DATED : July 3, 2001
INVENTOR(S) : David J. Stork

It is certified that error appears in the above-identified patent and that said Letters Patent is hereby corrected as shown below:

Column 1,
Line 5, after the phrase, "Mar. 26, 1998", insert
-- which is a continuation in part of and claims priority to S.N. 08/824,320 filed 3/36/97, now issued as U.S. Patent 5,837,658 --.

Signed and Sealed this

Tenth Day of June, 2003

JAMES E. ROGAN
*Director of the United States Patent and Trademark Office*